United States Patent [19]

Akkerman et al.

[11] 4,374,487

[45] Feb. 22, 1983

[54] PILOT WITH CANTILEVERED SPRING

[75] Inventors: Neil H. Akkerman, Kingwood, Tex.; Bruce D. Christensen, New Orleans, La.

[73] Assignee: Baker CAC, Belle Chasse, La.

[21] Appl. No.: 225,593

[22] Filed: Jan. 16, 1981

Related U.S. Application Data

[63] Continuation of Ser. No. 23,201, Mar. 23, 1979, abandoned.

[51] Int. Cl.[3] ..... F16K 31/385

[52] U.S. Cl. ..... 92/95; 92/133; 137/82; 251/61

[58] Field of Search ..... 137/82, 85, 86, 84; 251/61, 63.4; 92/84, 130 B, 95, 133

[56] References Cited

U.S. PATENT DOCUMENTS

| | | | |
|---|---|---|---|
| 2,612,908 | 10/1952 | Tate | 137/82 X |
| 2,793,540 | 5/1957 | Cronk | 137/85 X |
| 2,816,562 | 12/1957 | Dyson | 137/85 |
| 2,980,075 | 4/1961 | Cunningham | 137/85 X |
| 2,989,063 | 6/1961 | Clark | 137/85 |
| 3,140,047 | 7/1965 | Holloway | 137/85 X |

*Primary Examiner*—Alan Cohan

*Attorney, Agent, or Firm*—William C. Norvell, Jr.

[57] ABSTRACT

A fluid actuated pilot assembly employing a cantilevered spring member which is mounted to apply a force to a sensing piston in opposition to the force applied by the sensed fluid pressure. Upon the occurrence of the pressure of the fluid being sensed exceeding the force of the cantilevered spring member, the sensing piston is moved to initiate a control function.

8 Claims, 9 Drawing Figures

PILOT WITH CANTILEVERED SPRING

CROSS-REFERENCE TO RELATED APPLICATION

This application is a continuation application of copending application serial No. 023,201 filed March 23, 1979, and entitled "Pilot with Cantilevered Spring," now abandoned.

BACKGROUND OF THE INVENTION

1. Field of the Invention

The invention relates to a control pilot valve apparatus for use in, for example, conduits carrying a sensed fluid to shift an operating valve from one position to another position.

2. Description of the Prior Art

There are many pilot assemblies available for use in safety systems for monitoring a flow line pressure and sending a signal to or removing a signal from an end device, such as a safety valve, or a control console.

The most common pilot assembly employed is known as a spool pilot that employs a spool valve and a sensing piston opposed by an adjustable coil spring. For example, when the pressure of the fluid being sensed by the piston overcomes the force of the associated spring, the flow of control fluid through the spool valve is altered to control flow within a conduit. It will be appreciated that in such systems, the coil spring assembly generally must be guided to minimize friction. The systems are typically only 88 to 90% accurate with respect to repeatability of the trip point of the associated valving arrangements. Presently, government regulations require such systems to be much more accurate in their sensing properties, particularly with respect to repeatability.

There are spool pilot assemblies which are able to meet the present higher accuracy requirements, but are deemed to be commercially very expensive.

Bourdon tube assemblies are also used for sensing flow line pressures and monitoring the same. However, these assemblies have limited over-pressure capacities. If the Bourdon tube assemblies are used to sense systems at a pressure of 1500 psi, the maximum limiting pressure may be 2,000 psi. This is not very satisfactory when the system is employed in connection with sensing a flowing well which typically operates at a pressure of 2,000 psi, and, then when the well is shut in, the pressure may rise to 5,000 psi, considerably above the capacity of the monitoring system.

It is an object of the invention to provide a sensing system which is inexpensive to produce and has a substantial range of sensitivity and a high overpressure capacity.

Another object of the invention is to provide a fluid pressure pilot assembly having low sensing frictional characteristics.

Another object of the invention is to provide a fluid pressure pilot assembly exhibiting a high motion amplification capability.

Another object of the invention is to provide a fluid pressure pilot assembly wherein the primary spring biasing force is removed from the motion amplification system.

Another object of the invention is to provide a pressure fluid pilot assembly employing a cantilevered spring member which is stable, inherently self-guided, and may be guided through its movement with minimal frictional contact.

SUMMARY OF THE INVENTION

The objects of the invention are typically achieved by a fluid pressure pilot assembly comprising a sensing piston; means providing a fluid-tight seal between a source of fluid pressure to be sensed and the piston and movable toward and away from the piston upon a change in the pressure of the sensed fluid; and a cantilevered spring means having a static and a dynamic end portion, the dynamic end portion of the spring means normally resisting movement of the piston, whereby control means is actuated by the movement of the piston when the pressure of the fluid being sensed causes the piston to move in opposition of the force of the spring means.

DESCRIPTION OF THE PREFERRED EMBODIMENTS

Figure 1:
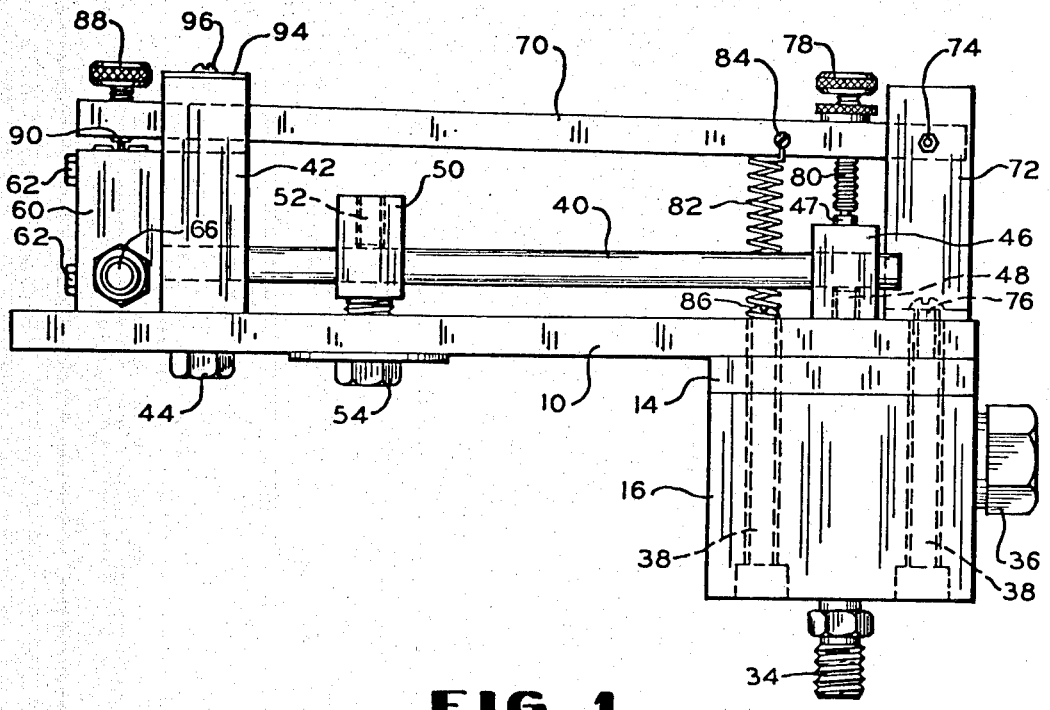
FIG. 1 is an elevational view of a fluid pressure pilot assembly incorporating the features of the invention.
Figure 2:
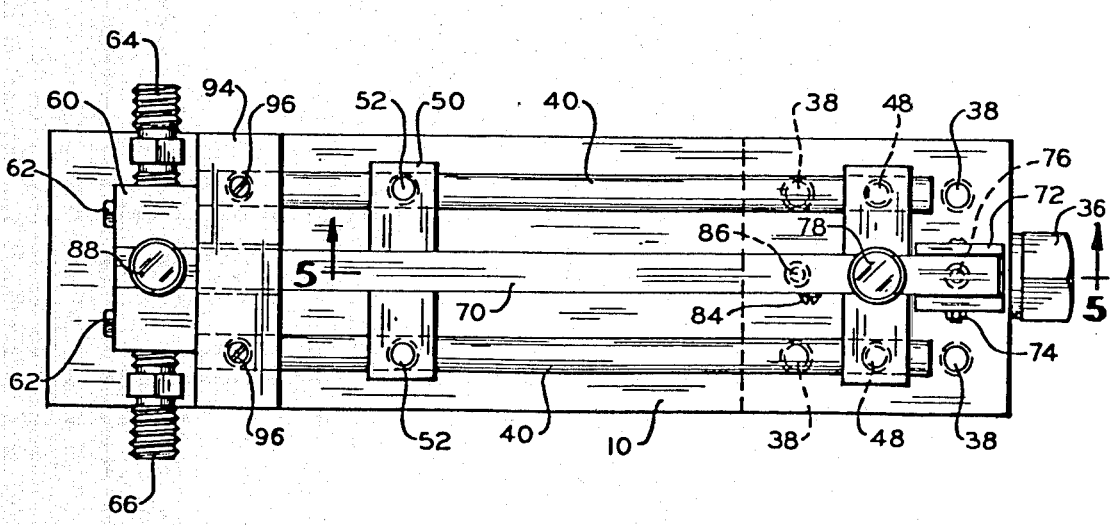
FIG. 2 is a top planar view of the assembly illustrated in FIG. 1.
Figure 3:
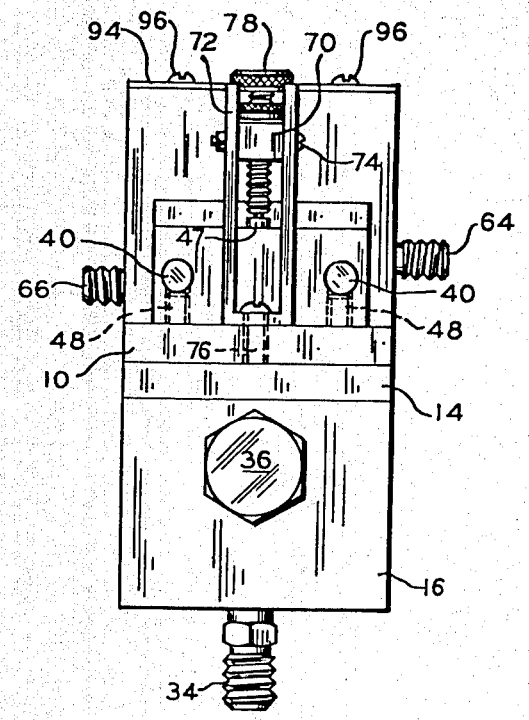
FIG. 3 is an end elevational view of the assembly illustrated in FIG. 1 as viewed from the right-hand side thereof.
Figure 4:
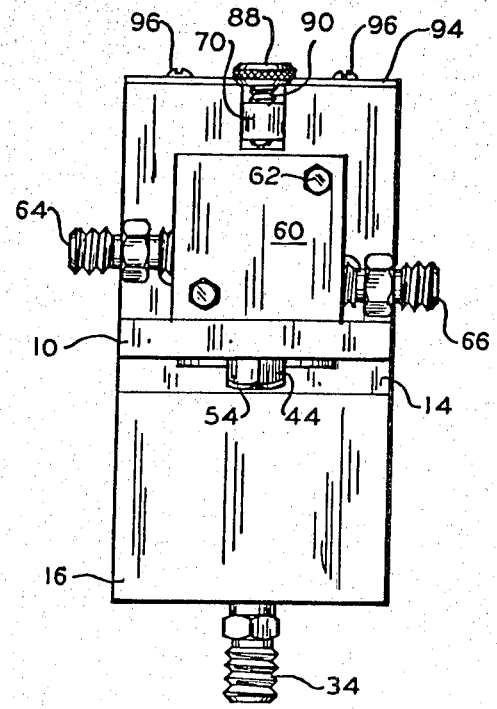
FIG. 4 is an end elevational view of the assembly illustrated in FIG. 1 as viewed from the left-hand side thereof.
Figure 5:
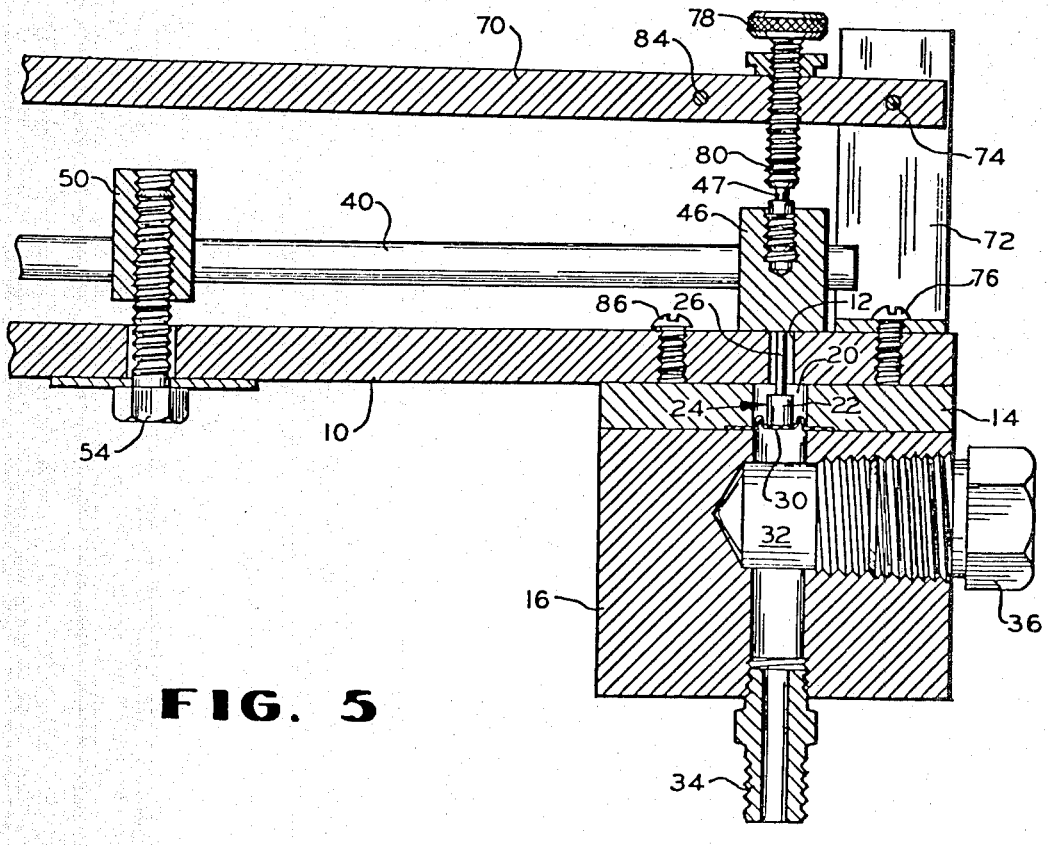
FIG. 5 is a fragmentary sectional view of a portion of the assembly illustrated in FIG. 1 taken along line 5—5 thereof.

Referring to FIGS. 1 through 5, inclusive, there is shown a fluid pressure pilot assembly incorporating a motion amplification mechanism. More specifically, there is provided an elongate rigid mounting plate 10 having an aperture 12 formed adjacent one end thereof. A diaphragm mounting plate 14 and an associated diaphragm cover plate 16 are secured in relation to the undersurface of the mounting plate 10 by a plurality of threaded fasteners 38 adapted to extend through aligned apertures formed in the mounting plate 14 and the cover plate 16 and threadably received within suitably positioned internally threaded apertures in the mounting plate 10.

The diaphragm mounting plate 14 is provided with a central chamber 20 adapted to receive the main body portion 22 of a piston 24. The piston 24 has an upwardly extending extension 26 which is adapted to be received within the aperture 12 of the mounting plate 10.

A diaphragm member 30 is positioned to completely cover the the lower open end of the chamber 20 of the mounting plate 14. The diaphragm member 30 is of the rolling diaphragm type and is typically comprised of a fabric material with an elastomeric coating.

The diaphragm cover plate 16 has an internal sensing chamber 32 generally in alignment with the diaphragm 30 and the chamber 20 of the diaphragm mounting plate 14. The sensing chamber 32 communicates with the source of fluid pressure being sensed through a threaded aperture provided with a fitting 34. Also, an alternative threaded aperture is formed in the wall of the sensing chamber 32 of a larger diameter and is shown as being closed by an externally threaded plug 36. With the illustrated structure, a separate line could be coupled between the fitting 34 and the source of fluid pressure, such as a flow line of a gas well, for example; or alternately, plugging the fitting 34, removing the plug 36, and attaching the assembly directly to the flow line at that point.

The plurality of threaded fasteners 38 is employed to couple the diaphragm mounting plate 14 and the diaphragm cover plates 16 to the underside of the mounting bar 10. Typically, the threaded fasteners 38 are adapted to extend through suitably positioned and aligned holes in the diaphragm cover plate 16 and the diaphragm mounting plate 14 and are thence threadably received within suitably tapped internally threaded holes in the mounting plate 10.

In the assembled form, the diaphragm member 30 functions to provide a fluid-tight seal between the fluid pressure being sensed in the sensing chamber 32 of the diaphragm cover plate 16, and atmospheric pressure of the remainder of the assembly. It will be appreciated that pressure in the sensing chamber 32 acts on the under surface of the diaphragm member 30 which is exposed to the interior of the sensing chamber 32. The force produced by the sensed fluid pressure is then transmitted through the diaphragm member 30 to the piston 24. As the pressure of the fluid within the sensing chamber 32 increases, a proportional increase will occur in the force applied to the piston 24 by the diaphragm member 30. One of the advantages in the use of the type of diaphragm illustrated is that virtually no sliding friction is involved during the operation thereof.

Further, it will be noted that the diameter of the sensing elements may be changed without affecting any other portion of the assembly by merely removing the threaded fasteners 38 and the diaphragm cover plate 16, and then substituting a new diaphragm mounting plate 14 having a different diameter diaphragm member 30 and central chamber 20 for the cooperating sensing piston 24. Such modification will result in the assembly having different (higher or lower) sensing ranges without the necessity of changing the spring force.

A pair of cantilevered spring rods 40 are mounted in horizontally extending spaced relation within a pilot valve mounting plate 42. The mounting plate 42 is secured to the upper surface of the mounting plate 10 by a threaded fastener 44 which is adapted to extend through an aperture formed in the mounting plate 10 and thence into an internally threaded aperture in the base of the mounting plate 42. One end of each of the spring rods 40 is inserted into and snuggly retained within spaced apart holes drilled in the mounting plate 42. The opposite or dynamic ends of the spring rods 40 are retained in spaced relation with respect to one another by a spring clamp 46 provided with a pair of spaced apart apertures for receiving the ends of the spring rods 40. The spring clamp 46 is securely fastened to the spring rods 40 by set screws 48, as illustrated in dotted lines in FIGS. 1 and 2, and is positioned over the extension 26 of the sensing piston 24. The spring clamp 46 provides side-to-side stability for the spring rods 40. The spring clamp 46 receives a leveling pad 47 which is defined at the lower end of the nut assembly 78.

An adjustable spring clamp 50, having spaced apart horizontally extending apertures for receiving the spring rods 40, is securely attached thereto by respective set screws 52. The adjustable spring clamp 50 is adjustably secured to the mounting plate 10 by means of an adjustable threaded shank 54 which extends through an aperture in the mounting plate 10 and thence into an internally threaded aperture extending upwardly from the base of the clamp 50 intermediate to the location of the spring rods 40. When the threaded shank 54 is tightened by turning the head portion thereof in a clockwise direction, the spring rods 40 are put under load. The tighter the threaded shank 54 is adjusted, the more pre-load force is applied to the associated spring clamp 46 on the reaction ends of the spring rods 40 to the extension 26 of the sensing piston 24.

Accordingly, it will be seen that the piston 24 may be moved by the force transmitted thereto from the sensed fluid pressure through the movement of the diaphragm member 30, only after the applied force overcomes the oppositely applied force of the spring rods 40 acting through the spring clamp 46.

As the sensed pressure becomes higher and higher, the spring rods 40 deflect and the forces of the spring rods 40 become correspondingly increased. The amount of deflection that the spring rods 40 traverse will, of course, be very small.

A pilot valve assembly 60 is mounted to the side wall of the pilot valve mounting plate 42 by means of spaced apart threaded fasteners 62. The pilot valve assembly 60 may be typically a three-way, two position poppet valve having no sliding seals. In order to shift the valve assembly 60, a force must be applied. The force required to shift the valve is a function of pilot valve supply pressure and not a friction characteristic. It is a very repeatable force if the supply pressure is regulated carefully. The pilot valve assembly 60 is effective to control a fluid which is allowed to flow therethrough from the inlet fitting 64 to the outlet fitting 66 and the above referred to force is typically required to shift the valve assembly from an open to a closed condition. Typically, the stroke required to actuate the pilot valve 60 is comparatively small. As pressure increases, the sensing piston 24 is moved against the force of the spring rods 40 a distance of approximately 10% of the pilot valve 60 stroke for each 1% change in sensed pressure. This means that if the pilot valve assembly 60 were mounted directly to the spring clamp 46 of the spring rods 40 for tripping and resetting purposes, the trip point to reset point, or dead-band, would vary 10% or more. To reduce this dead-band and probability of nonrepeatable functions, a motion amplification system is provided as illustrated in FIGS. 1, 2, 3, and 4.

The motion amplification system includes a transfer bar 70 having one end pivotally mounted in a U-shaped mounting bracket 72, by a threaded fastener 74. The mounting bracket 72 is typically secured to the mounting bar 10 by suitable threaded fastening means 76. A threaded nut assembly 78 is mounted on the transfer bar 70 and includes a depending threaded shank portion 80, the end of which has an integral leveling pad 47 which is aligned to contact the spring clamp 46.

The transfer bar 70 is normally urged about the pivot point of the threaded fastener 74 by a coil spring 82 so that the leveling pad 47 of the depending shank portion 80 remains in contact with the spring clamp 46, thereby assuring no undesired sloppiness or misalignment in the respective contacting elements.

One end of the coil spring 82 is secured to the transfer bar 70 by a threaded fastener 84, while the opposite end is secured to the mounting plate 10 by a threaded fastener 86.

The opposite end of the transfer bar 70 is provided with an adjustable nut assembly 88 having a depending threaded shank portion 90 adapted to contact the operating element of the pilot valve assembly 60.

The transfer bar 70 is guided, during movement thereof, by a milled slot 92 in the upper portion of the pilot valve mounting plate 42 and is retained therein by a plate 94 secured to the plate 42 by a pair of threaded fasteners 96.

Accordingly, in operation, as the sensing piston 24 is moved upwardly by the pressure of the fluid being sensed against the opposing force of the spring rods 40, the spring clamp 46 urges the transfer bar 70 upwardly about the pivot axis of the threaded fastener 74. Since the distance from the longitudinal axis of the adjustable nut assembly 78 to the pivot axis of the threaded fastener 74 is of the order of one-eighth the distance from the axis of the nut assembly 78 to the corresponding axis of the adjustable nut assembly 88, the upward movement of the sensing piston will be in effect amplified eight times at the pilot valve assembly 60.

While in the illustrated preferred embodiment of the invention upward movement of the sensing piston 24 causes upward movement of the reaction end of the transfer bar 70, the arrangement may be readily changed to reverse the above action. In the event such change is desired, the mounting bracket 72 is mounted at the location on the mounting plate 10 where the threaded fastener 86 is used to normally maintain the bottom portion of the coil spring 82. The transfer bar 70 is then pivotally mounted to the mounting bracket 72 at the aperture in the bar 70 which is employed to receive the threaded fastener 86. The coil spring 82 is attached to the end of the transfer bar 70 where it had been pivotally mounted to the mounting bracket 72, as illustrated.

Figure 6:
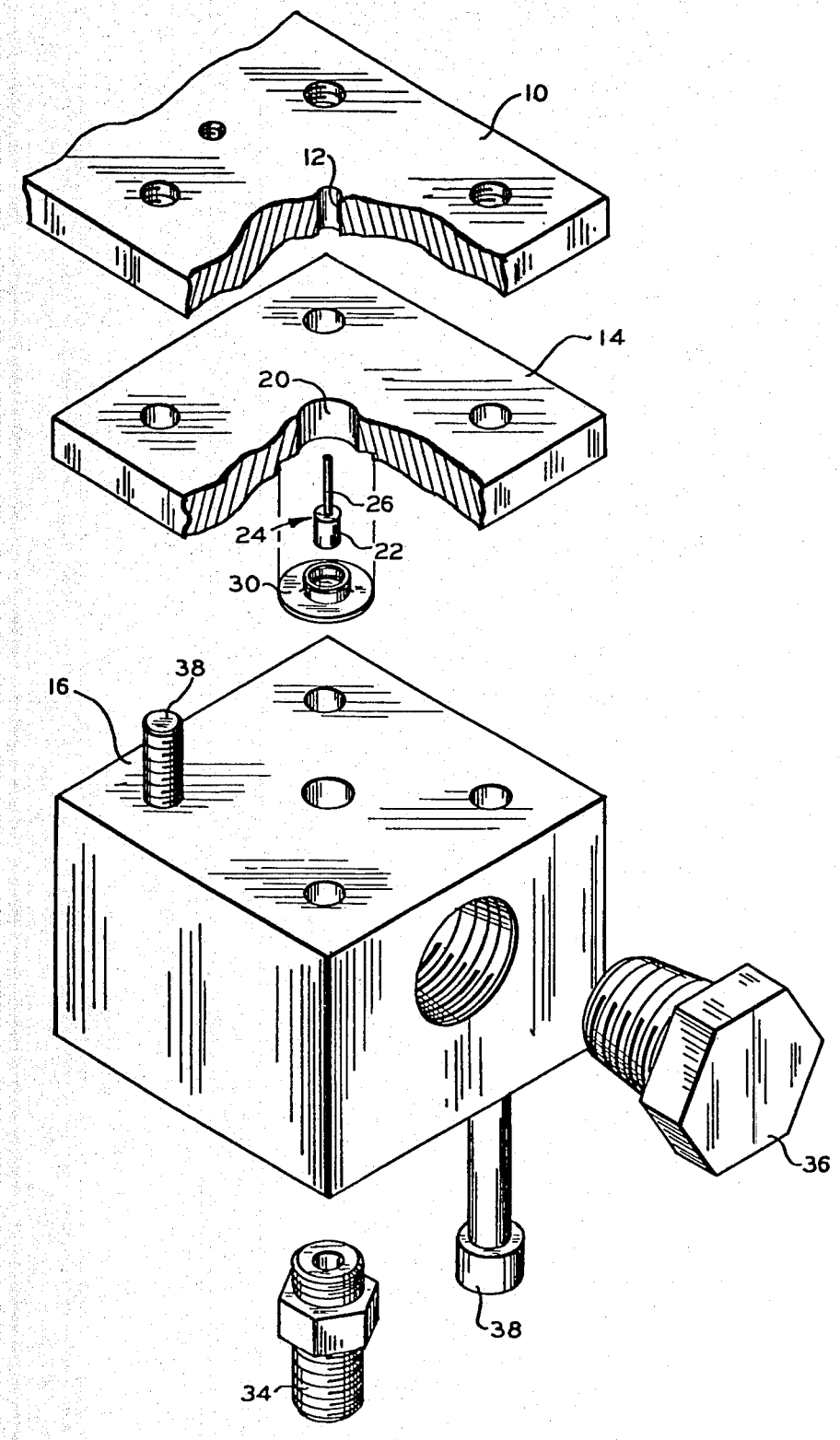
FIG. 6 is a fragmentary exploded view of the internal configuration of diaphragm mounting plate and the associated diaphragm cover plate.
Figure 7:
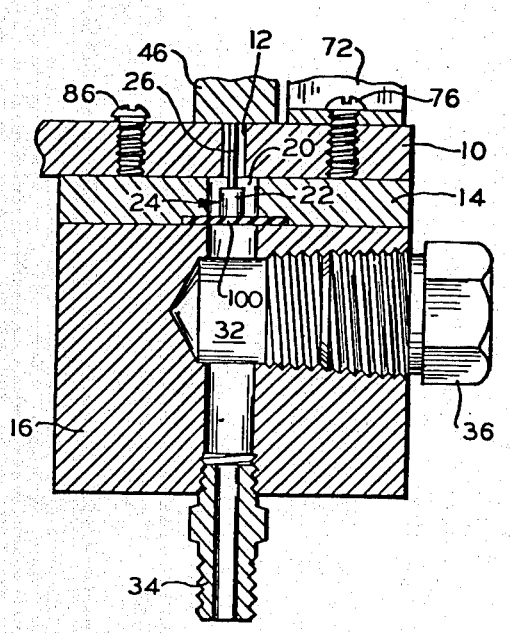
FIG. 7 is a fragmentary sectional view of a modified form of a sensing piston and associated cooperating solid elastomer diaphragm element.

FIG. 7 shows a modified form of the diaphragm and sensing piston arrangement. While the rolling type diaphragm illustrated in FIGS. 5 and 6 may be made to accommodate pressures above 2,000 psi, the normal usage of such diaphragm 30 is in a range below about 2,000 psi. The modification illustrated in FIG. 7 is designed for higher pressure ranges and utilizes a flat disc elastomer sensing element 100. In this embodiment, the cooperating sensing piston 24 fits relatively closely into the cooperating chamber 20. This embodiment is useful when the system is used to sense high pressures, and utilizes very small piston configurations.

Figure 8:
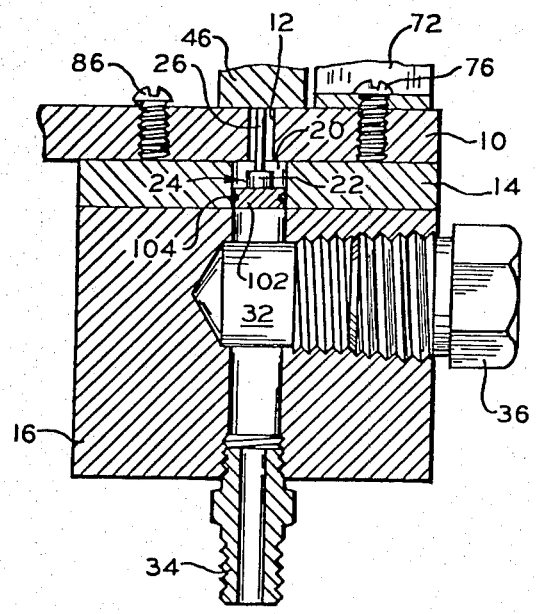
FIG. 8 is a fragmentary sectional view of another modified form of the sensing piston and associated sealing means.

The embodiment illustrated in FIG. 8 is a modified form of the sensing arrangement and includes a piston 102, in lieu of a diaphragm, which employs a seal member 104 to maintain a sealing relation between the sensing piston 24 and the pressure fluid being sensed in the sensing chamber 32.

In all instances, it is an important objective of the mechanism comprising the assembly to utilize moving elements which exhibit a minimum amount of frictional contact.

Figure 9:
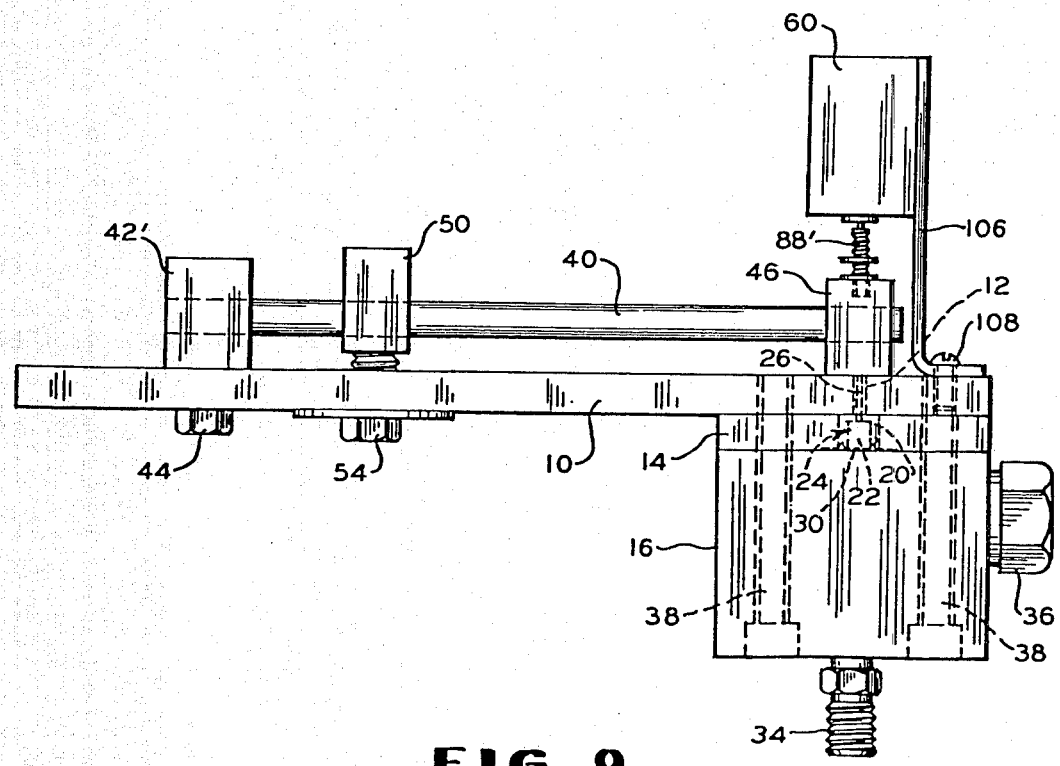
FIG. 9 is an elevational view similar to FIG. 1 showing a modified form of a fluid pressure pilot assembly wherein the motion amplification system has been eliminated.

FIG. 9 illustrates another embodiment of the invention wherein the pilot assembly is in most all structural aspects similar to the assembly illustrated in FIGS. 1, 2, 3, 4, 5, and 6 with the exception of the elimination of the motion amplification system and the relocation of the pilot valve assembly. More specifically, spring rods 40 are mounted in a mounting bracket 42' secured to the mounting plate 10 by a threaded fastener 44 in the same manner as the pilot valve mounting plate 42 of the earlier described embodiment is mounted. However, the pilot valve assembly 60 is mounted at the opposite end of the mounting plate 10 to co-act directly with sensing piston 24 of the associated spring clamp 46. The lower end of the mounting bracket 106 is secured to the mounting plate 10 by threaded fastener 108, while the upper end supports the pilot valve assembly 60. In operation, it will be seen that an adjustable nut assembly 88' is mounted at the top of the spring clamp 46 and employed to physically contact and shift the poppet valve mechanism of the pilot valve assembly 60 upon movement of the sensing piston 24. As discussed above, this arrangement typically would exhibit a trip point to reset point, or dead-band, of 10% or more. However, in certain applications, this may be acceptable and the mechanism would be simplified. By careful selection of the size, or spring rate of the spring rods 40 relative to the size of the sensing element and in consideration of the required sensing pressure range, this configuration might well be designed to provide less than 10% dead-band.

While the illustrated embodiments show the diaphragm cover plate assembly as being coupled to a single pilot valve assembly, it is clearly within the spirit of the invention to couple a plurality of pilot valve assemblies to the diaphragm cover plate.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A fluid pressure actuated pilot comprising: a sensing piston; diaphragm means providing a fluid-tight seal between a source of fluid pressure to be sensed and said piston, said piston and a portion of said diaphragm means being movable upon changes in the pressure of the sensed fluid; a pair of cantilevered spring rods, each of said rods having a static end portion and a dynamic end portion opposite said static end portion, said dynamic end portions of said spring rods disposed for common movement in a reference plane substantially normal to the movement of said piston, means fixedly secured to said dynamic end portions of said rods for interconnecting said dynamic end portions of said rods and operably coupling said dynamic end portions of said rods to said piston; clamp means fixedly secured to said rods intermediate said static end portions and said dynamic end portions and adjustment means coupled to said clamp means for displacing said rods in a direction normal to said reference plane whereby the static preload force of said spring rods may be increased and decreased by adjusting said adjustment means.

2. A fluid pressure actuated pilot comprising: a sensing piston; diaphragm means providing a fluid-tight seal between a source of fluid pressure to be sensed and said piston, said piston and a portion of said diaphragm means being movable upon changes in the pressure of the sensed fluid, said diaphragm means including a removable member for providing a preselected piston force versus pressure relationship; a pair of elongate spring rods normally resisting movement of said piston in one direction and disposed in spaced-apart relationship in a common plane oriented substantially normal to the line of movements of said piston; said spring rods having adjacent stationary ends secured to a fixed support and adjacent dynamic ends fixedly secured to a coupling member, clamp means fixedly secured to said spring rods intermediate said stationary ends and said dynamic ends, and adjustment means coupled to said clamp means for translating said clamp means and adjacent portions of said spring rods in a direction substantially normal to said common plane and adjusting a static preload force of said spring rods, whereby a control means is actuated by the movement of said piston when the pressure of the fluid being sensed causes said piston to move in opposition to the force of said spring means.

3. A fluid pressure actuated pilot comprising: a first mounting plate having an aperture formed adjacent one end thereof; a pair of spaced-apart elongate spring rods, said pair of rods disposed for motion in a common plane; bracket means for mounting one end of said spring rods to said first mounting plate; clamp means attached to the other end of said rods in alignment with the aperture formed in said first mounting plate; coupling means disposed on said rods at a fixed axial location between said bracket means and said clamp means, threaded adjustment means for translating said coupling means and adjacent portions of said spring rods in directions normal to said common plane for providing an adjustable static preload force directed toward said first mounting plate; a second mounting plate secured to said first mounting plate having a piston receiving cavity formed therein in general alignment with the aperture in said first mounting plate; a piston disposed within the cavity in said second mounting plate for motion along an axis normal to said common plane, said piston having a portion thereof extending into the aperture in said first mounting plate; and a cover plate secured to said second mounting plate, said cover plate having a chamber which provides communication between a source of fluid pressure being sensed and said piston whereby when the pressure of the fluid being sensed exceeds the force applied by said spring rods, said piston is moved causing simultaneous movement of said clamp means and the associated ends of said spring rods.

4. A fluid pressure actuated pilot comprising: a first mounting plate having an aperture formed adjacent one end thereof; a pair of elongate spring rods disposed in spaced relationship in a reference plane substantially normal to the flexing motion of said rods; means for fixedly mounting one end of each of said spring rods to said first mounting plate; first coupling means for interconnecting the other, dynamic end of each of said spring rods disposed in alignment with the aperture formed in said first mounting plate; second coupling means secured to said spring rods at a fixed axial location intermediate said one and said other end of each of said spring rods threaded adjustment means interposed said second coupling means and said first mounting plate for translating said second coupling means and adjacent portions of said spring rods along an axis substantially normal to said reference plane and adjusting the movement versus force function of said spring rods; a second mounting plate secured to said first mounting plate having a piston receiving cavity formed therein in general alignment with the aperture in said first mounting plate; a piston disposed within the cavity in said second mounting plate and having a portion thereof extending into the aperture in said first mounting plate, and a cover plate secured to said second mounting plate, said cover plate having a chamber which provides communication between a source of fluid pressure being sensed and said piston whereby when the pressure of the fluid being sensed exceeds the force applied by said spring rods, said piston is moved causing simultaneous movement of said interconnecting means and the associated ends of said spring rods.

5. A fluid pressure actuated pilot comprising: a sensing piston; diaphragm means providing a fluid-tight seal between a source of fluid pressure to be sensed and said piston; said diaphragm means including means for providing a preselected force versus sensed fluid pressure relationship; a pair of spaced-apart cantilevered spring rods having a static and a dynamic end portion, the dynamic end portions of said spring rods normally resisting movement of said piston and moving in a respective one of a pair of parallel, spaced-apart fixed planes; clamp means coupled to said spring rods at a fixed location intermediate said static and dynamic end portions, and threaded adjustment means for bi-directionally translating said clamp means and portions of said spring rods in said parallel, spaced-apart fixed planes for providing an adjustable static preload opposing movement of said piston; and pivotally mounted lever means having one portion arranged to be moved about its pivot by movement of said piston whereby control means is actuated by the movement of said lever means when the pressure of the fluid being sensed causes said piston to move in opposition to the force of said spring means.

6. A fluid pressure actuated pilot comprising: a sensing piston; diaphragm means providing a fluid-tight seal between a source of fluid pressure to be sensed and said piston; said diaphragm means including means for providing a preselected force versus sensed fluid pressure relationship; a pair of spaced-apart cantilevered spring rods having a static end portion and a dynamic end portion opposite said static end portion, said dynamic end portions of said spring rods fixedly secured within a clamp block, operably coupled to said piston and moving in a pair of parallel spaced-apart reference planes; a coupling device fixedly secured to said spring rods intermediate said static end portions and said dynamic end portions and threaded adjustment means engaging said coupling device for moving said coupling device and adjacent portions of said spring rods in said reference planes and for adjusting the preload force of the dynamic end portion of said spring means, whereby a control means is actuated by the movement of said piston to move in opposition to the force of said spring means.

7. A fluid pressure actuated pilot comprising: a sensing piston; diaphragm means providing a fluid-tight seal between a source of fluid pressure to be sensed and said piston; a pair of elongate cantilevered springs defining a pair of axes, each of said springs having a static and a dynamic end portion, said dynamic end portions of said springs secured within a clamp structure, said clamp structure generally longitudinally aligned with and operably coupled to said piston, said springs disposed for movement in a pair of substantially parallel, spaced-apart reference planes; coupling means fixedly secured to said springs intermediate said static and said dynamic end portions; threaded adjustment means engaging said coupling means for bi-directionally moving said coupling means and portions of said springs in said reference planes and for varying the preload force of the dynamic end portion of said spring means; and lever means pivotally mounted with respect to said piston and having one portion arranged to be moved about its pivot by said piston whereby control means is actuated by the movement of said lever means when the pressure of the fluid being sensed causes said piston to move in opposition to the force of said spring means.

8. The fluid pressure actuated pilot of claim 5 wherein said lever means is a third class lever.

* * * * *